US005575032A

United States Patent [19]

Cernuska

[11] Patent Number: 5,575,032

[45] Date of Patent: Nov. 19, 1996

[54] SPONGE SHOWER CLEANER

[76] Inventor: John Cernuska, 6031 W. Berenice, Chicago, Ill. 60634

[21] Appl. No.: 417,654

[22] Filed: Apr. 5, 1995

[51] Int. Cl.[6] ..... A47L 13/14

[52] U.S. Cl. ..... 15/119.2; 15/244.1

[58] Field of Search ..... 15/116.2, 119.2, 15/244.1, 118

[56] References Cited

U.S. PATENT DOCUMENTS

| | | | |
|---|---|---|---|
| 2,163,638 | 6/1939 | Vaughn . | |
| 2,469,060 | 5/1949 | Vosbikian et al. . | |
| 2,683,887 | 7/1954 | Bell . | |
| 2,694,210 | 11/1954 | Bitzer et al. . | |
| 2,742,659 | 4/1957 | McGraw . | |
| 2,794,998 | 6/1958 | Watt . | |
| 3,031,705 | 5/1962 | Herman et al. | 15/244.1 |
| 3,038,188 | 6/1962 | Rebernak | 15/119.2 |
| 3,039,126 | 6/1962 | Kessler . | |
| 3,259,933 | 7/1966 | Clause | 15/244.1 |
| 3,287,756 | 11/1966 | Gesell | 15/119.2 |
| 3,483,583 | 12/1969 | Baumgartner . | |
| 5,438,727 | 8/1995 | Specht | 15/119.2 |

FOREIGN PATENT DOCUMENTS

| | | | |
|---|---|---|---|
| 1346263 | 11/1963 | France | 15/119.2 |
| 967566 | 8/1964 | United Kingdom . | |

*Primary Examiner*—David Scherbel
*Assistant Examiner*—Randall E. Chin
*Attorney, Agent, or Firm*—Fitch, Even, Tabin & Flannery

[57] ABSTRACT

A sponge shower cleaner for wiping a surface exposed to moisture, such as vertical shower wall is provided including a cleaning head formed from an absorbent material having a leading cleaning surface and an inclined surface. The inclined surface extends away from the leading cleaning surface at an angle. A cleaning head holder includes a guideway track for receipt and mounting of the cleaning head thereon. A wringing member is connected to the holder and defines a space between the cleaning head inclined surface and the wringing member. An elongated handle is thus two feet in length is connected to the holder and allows the user to orient the leading cleaning surface against and along the surface to be cleaned. The handle is usable with one hand to press the wringing member and the inclined surface against the surface to compress the absorbent material of the cleaning head to extract any moisture and any particulate matter picked up by the cleaning head.

7 Claims, 4 Drawing Sheets

SPONGE SHOWER CLEANER

FIELD OF THE INVENTION

The present invention relates to a sponge shower cleaner for wiping a surface exposed to moisture, and more particularly, a sponge shower cleaner which is usable with one hand to wring the sponge so as to extract moisture picked up by the sponge.

BACKGROUND OF THE INVENTION

A shower requires regular cleaning to prevent dirt and mildew from setting in on the shower surfaces such as the ceramic tiles and grout therebetween, porcelain, plastic and/or glass surfaces that are typically found in a shower area. Normally, a shower is used potentially numerous times, on a daily basis, whereas shower cleaning only occurs on a periodic basis, such as once a week. Such periodic cleaning typically requires the purchase of bathroom cleansers which are applied to the surfaces to be cleaned. The surfaces are then scrubbed to remove the accumulated dirt and mildew to clean the shower area. Insofar as frequent purchase of these cleansers can be fairly expensive and the scrubbing action required to be exerted during the periodic cleanings using these cleansers can be fairly difficult, there is a need for a shower cleaner which readily allows for a more regular cleaning of the shower without exacting the time and effort that is normally required with weekly periodic cleanings using purchased shower cleansers. Preferably, the cleaner can be easily utilized to clean the shower area such that the area can be effectively and rapidly cleaned after each use thereof thereby increasing the time between the periodic cleanings and correspondingly reducing the necessity of frequent purchase of the cleansers used on the shower surfaces.

While it is known to use sponge cleaning heads with mops, sponge mops are not suitable for cleaning shower areas, particularly, vertical surfaces in the shower area. Mops normally include a relatively long handle angled relative to the cleaning head so that a user can clean a large area from a relatively stationary position and need not bend or stoop down while cleaning an open floor area with the mop. This long angled handle makes a mop difficult to manipulate in a confined shower area and, if used therein, requires a user to carefully maneuver themselves so as to properly position the mophead along the surface to be cleaned while simultaneously trying to avoid banging or knocking the handle on other surfaces in the area. This is made even more problematic if a user attempts to clean a vertical wall with a mop. Moreover, due to the length of the handle, a mop normally requires two hands to accurately and forcefully direct the mop head on the floor. Such maneuvering and two-handed use is made even more difficult and hazardous by moisture that accumulates on the floor of the shower or tub area after each use. Thus, a mop is not particularly well-adapted to be used for cleaning a shower area.

Furthermore, a mop would not normally be stored so that it would be easily accessible to someone after they have taken a shower. Typically, to get the mop, they would most likely have to get out of the shower, dry off and put clothes or a wrap on before traveling to a kitchen pantry or the like to get the mop. Thus, there is a need for a shower cleaner which is smaller and more compact versus a normal mop so that it can be stored in or near the shower readily accessible after each use of the shower.

A further safety problem with the use of mops in cleaning a shower is in the design of the wringing mechanism which normally requires a user to hold the handle with one hand and then activate the wringing mechanism with the other, as by operating a lever adjacent the handle to squeeze the sponge mophead to expel water therefrom. As stated earlier, the floor in a shower can be quite slippery due to the moisture accumulated thereon after each use. Therefore, if a sponge mop is used in the shower, the wringing thereof can pose substantial safety concerns as the user cannot use their free hand to support themselves in the shower while wringing the mop. Thus, there is a need for a shower cleaner which has a simple and compact design and allows one-handed operation thereof to both clean with the sponge cleaning head and wring the sponge cleaning head.

SUMMARY OF THE INVENTION

In accordance with the present invention, a sponge shower cleaner for wiping a surface exposed to moisture, such as a vertical shower wall, is provided which overcomes the aforementioned problems of the prior art. The sponge shower cleaner includes a cleaning head formed from an absorbent material having a leading cleaning surface and an inclined surface. The inclined surface extends away from the leading cleaning surface at an angle. A cleaning head holder includes a guideway track for receipt and mounting of the cleaning head thereon. A wringing member is connected to the holder and defines a space between the cleaning head inclined surface and the wringing member. An elongated handle less than two feet in length is connected to the holder and allows a user to orient the leading cleaning surface against and along the surface to be cleaned. The handle is usable with one hand to press the wringing member and the inclined surface against a surface to compress the absorbent material of the cleaning head to extract any moisture and particulate matter picked up by the cleaning head.

In one form, the wringing member includes a plurality of drain channels and drainage ports which extend through the wringing member. The drain channels provide flow path to the drainage ports for moisture and particulate matter extracted from the absorbent material when the absorbent material is compressed with the wringing member.

The base can include forward and rear flanges. The wringing member may be pivotably connected to the base about the rear flange to engage the inclined surface and compress the absorbent material substantially between the wringing member and the base. The elongated handle can be connected to the base approximately midway between the forward and rear flanges. The wringing member may extend parallel to the leading cleaning surface with the space defined by the wringing and inclined surface having an elongate wedge shape.

In another form of the invention, the leading cleaning surface faces in a first direction and the elongate handle extends perpendicular to the first direction.

The cleaning head holder may have a flat bottom surface connected to the handle with the handle extending perpendicular to the bottom surface.

In yet another form of the invention, the wringing member is pivotably connected to the holder and a handle connected to the holder is provided which allows a user with one hand to move the cleaning head and wringing member from one of a cleaning position and wringing position into the other of the cleaning position and the wringing position. In the cleaning position, the wringing member is not pivoted and the leading cleaning surface can be oriented along the surface to be cleaned. In the wringing position, the wringing member is pivoted as by pressing the wringing member against a surface to compress the absorbent material of the cleaning head to extract any moisture picked up by the cleaning head.

The leading cleaning surface and the wringing member can each have an edge thereof spaced from the cleaning head holder. The distance between the cleaning head holder and the wringing member edge may be greater than the distance between the cleaning head holder and the cleaning surface edge.

The wringing member can be adjacent the cleaning head with a free end portion of the wringing member extending outwardly from the cleaning head.

DETAILED DESCRIPTION OF THE PREFERRED EMBODIMENTS

Figure 1:
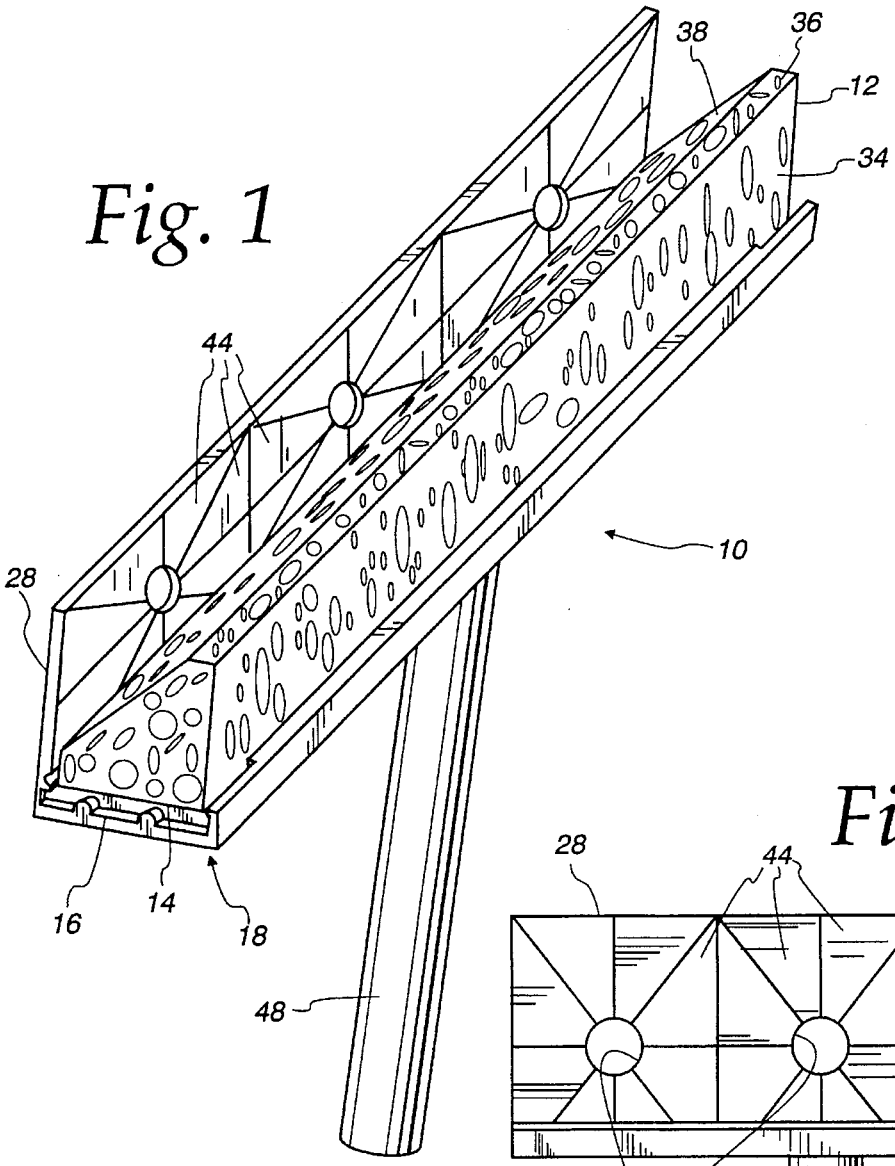
FIG. 1 is a perspective view of the sponge shower cleaner according to the invention.

FIG. 1 illustrates a sponge shower cleaner 10 of the present invention. The sponge shower cleaner 10 includes a cleaning head 12 which is formed from an absorbent material such as a sponge. The sponge cleaning head 12 has a flat bottom surface 14 to which a plate 16 can be attached as by an adhesive or any other known means for securing the plate 16 to the bottom surface of the sponge head 12. The plate 16 serves as a mounting plate for insertion into a cleaning head holder 18 and can be slightly larger than the bottom surface 14 so that when attached thereto a surrounding lip 19 is formed to facilitate insertion into the cleaning head holder 18 and retention of the cleaning head 12 thereby. The cleaning head holder 18, as most clearly seen in FIG. 3, defines a guideway track 20 having a flat bottom portion 22, with spaced upwardly turned front and rear flanges 24 and 26, respectively.

Figure 3:
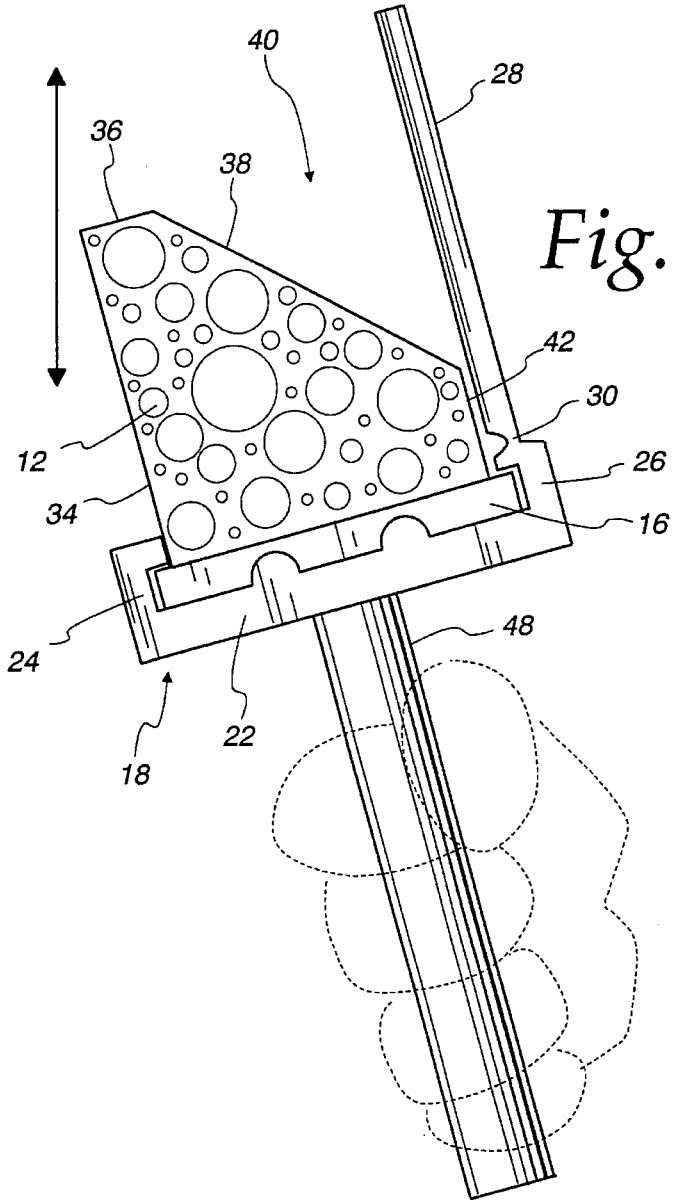
FIG. 3 is a side elevational view of the sponge shower cleaner of FIG. 1 being grasped by one hand and oriented for cleaning.
Figure 4:
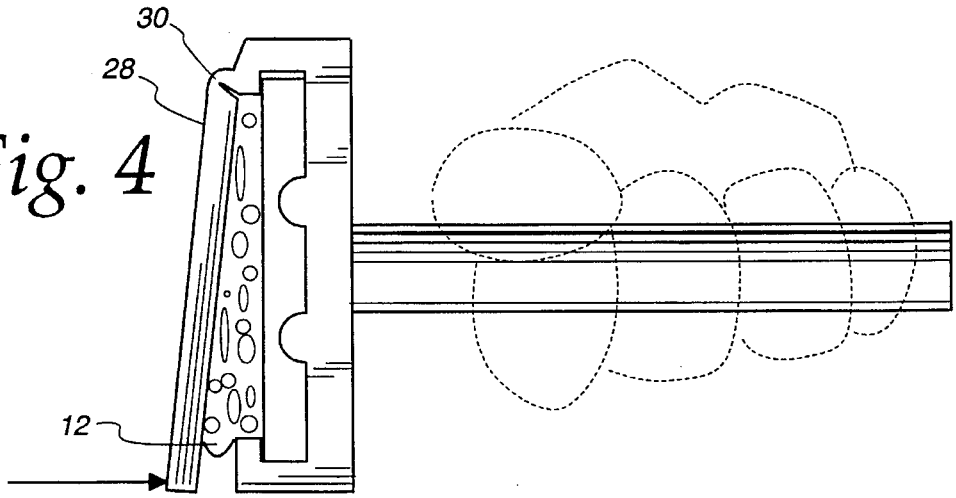
FIG. 4 is a side elevational view similar to FIG. 3 showing the sponge shower cleaner oriented so as to pivot a wringing member to compress the cleaning head.
Figure 5:
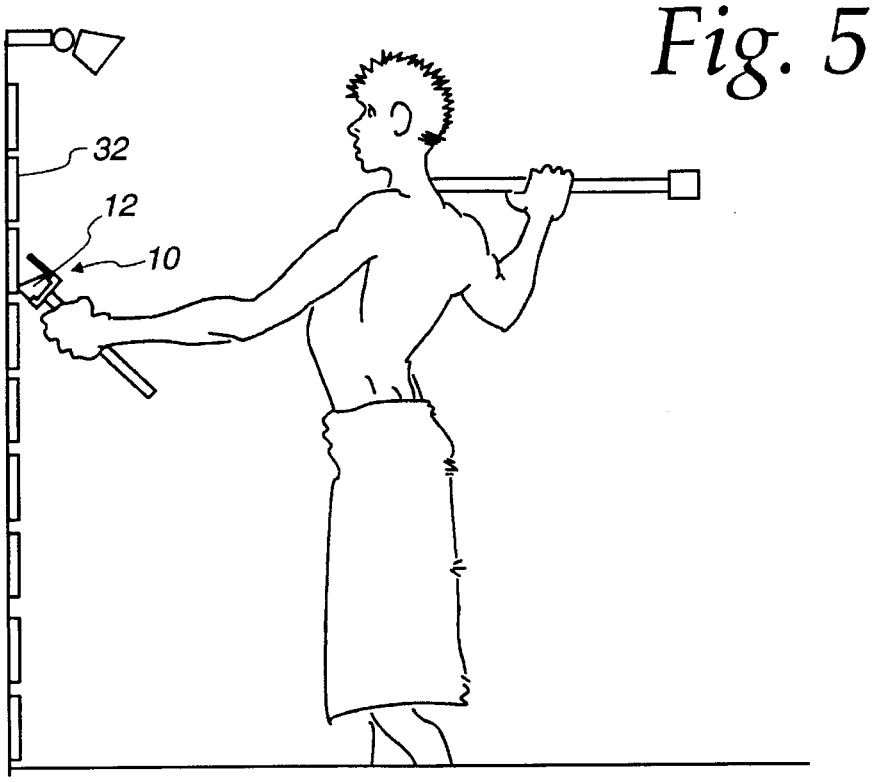
FIG. 5 is a view of the sponge shower cleaner in use, with the user cleaning a vertical shower wall with the sponge shower cleaner and supporting themselves in the shower with their free hand.
Figure 6:
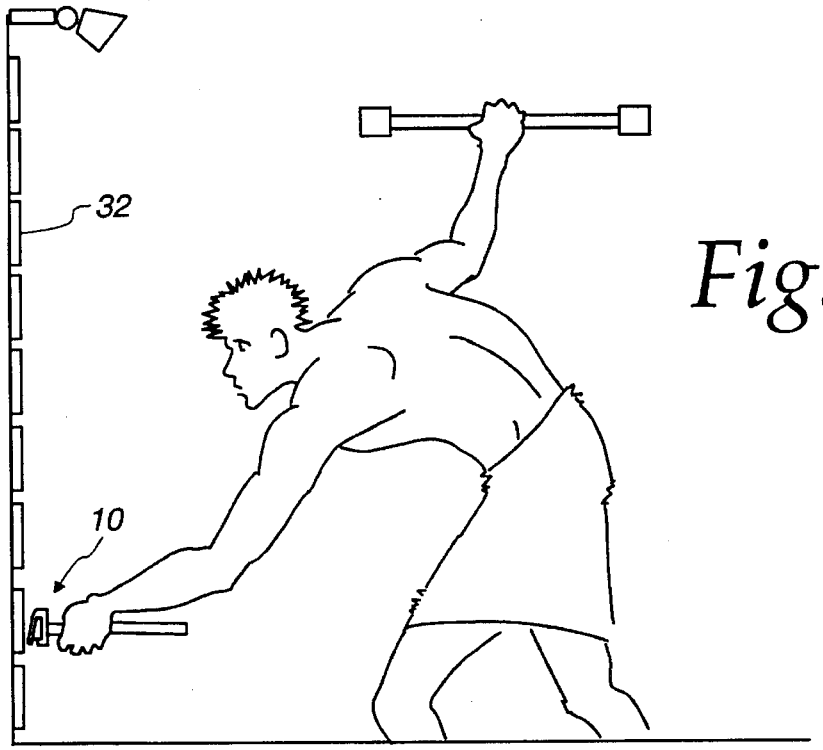
FIG. 6 is a view similar to FIG. 5 with the user wringing the sponge shower cleaner while supporting themselves in the shower with their free hand.

The sponge shower cleaner 10 includes a wringing member 28 which can be integrally formed with the cleaning head holder 18, and more specifically, the rear flange 26 of the track 20. The cleaning head holder 18 and wringing member 28 can be molded from a somewhat pliable but resilient plastic material. At the juncture of the wringing member 28 and the rear flange 26, the wringing member 28 has a region 30 of reduced cross-sectional thickness which allows the cleaning member 28 to pivot thereabout. In this manner, the wringing member 28 can be pressed against a surface so as to compress the sponge cleaning head 12 to thereby extract any moisture picked up thereby, as seen in FIGS. 4 and 6. When the sponge shower cleaner 10 is removed from the surface, the wringing member 28 resiliently rebounds to its original straightened position, as seen in FIGS. 3 and 5, and can then be reoriented to clean a shower wall.

Thus, the sponge shower cleaner 10 is particularly adapted to be used in a shower as a user need not employ both hands to effectuate a wringing of the sponge cleaning head 12. Referring to FIGS. 5 and 6, it can be seen that a vertical shower wall 32 can be readily cleaned with the sponge shower cleaner 10 of the present invention by orienting the sponge cleaning head 12 against the vertical shower wall 32 while simultaneously utilizing the free hand in the shower for support so as to limit the potential for any slipping that can occur in a shower due to the moisture accumulated on the floor after each use. Moreover, after a surface has been cleaned with the sponge shower cleaner 10, the sponge cleaning head 12 can be readily compressed by the wringing member 28 with one hand while again allowing for use of the free hand in a support function to limit the potential for slippage in the shower.

Figure 2:
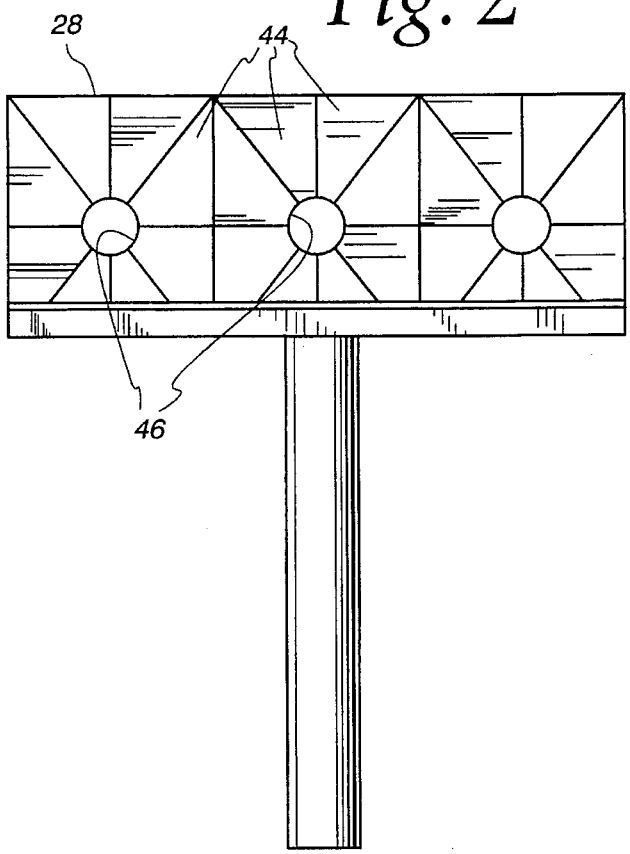
FIG. 2 is a front elevational view of the sponge shower cleaner of FIG. 1 with the cleaning head removed.

Returning to FIGS. 1 and 2, the sponge shower cleaner 10 is more fully described herein. As best seen in FIG. 1, the sponge cleaning head 12 has a leading cleaning surface 34. A top strip surface 36 extends rearwardly from the leading cleaning surface 34 to an inclined surface 38. The inclined surface 38 extends rearwardly from the top strip surface 36 towards the wringing member 28. By utilizing an elongate wedge shape cleaning head 12, a space 40 is formed between the inclined surface 38 and the wringing member 28. Therefore, when the wringing member 28 is pivoted about the thinned region 30 by pressing the wringing member against a surface, the wringing member 28 initially only engages a reduced height rear surface 42 of the sponge cleaning head 12. This allows the wringing member 28 to be more easily pivoted through the space 40 to engage the inclined surface 38 and compress the cleaning head 12 to extract moisture picked up by the cleaning head 12 therefrom. The elongate wedge shape of the sponge cleaning head 12, also reduces the sponge material required to form the cleaning head 12. Moreover, generally, the leading cleaning surface 34 will be oriented against a moist surface to be cleaned in the shower. Thus, primarily the region of the cleaning head 12 adjacent the leading cleaning surface 34 will absorb most of the moisture therein. Also, during use on a vertical shower wall, much of the moisture absorbed by the cleaning head 12 will migrate toward the bottom of the cleaning head 12 due to the force of gravity. As such, the portion of the cleaning head 12 that would otherwise be present if not for the inclined surface 38 would see limited amounts of moisture. Thus, removal of this relatively unused portion not only increases the performance of the sponge shower cleaner 10 by facilitating pivoting of the wringing member 28, but also lowers the raw material cost of the sponge head 12 and increases the efficiency in absorbing moisture with regards to the amount of the sponge material actually used in the cleaning head 12.

Referring again to FIGS. 1 and 2, the wringing member 28 is illustrated. The wringing member 28 is shown to have thickness to it so that a series of drainage channels 44 can be formed therein. The drainage channels 44 are formed on the side of the wringing member 28 facing the cleaning head 12 and lead to a series of drainage ports 46. The drainage ports 46 extend through the wringing member 28 such that when the wringing member is pivoted to compress the cleaning head 12, as illustrated in FIGS. 4 and 6, water that is extracted from the cleaning head by the compressing action of the wringing member against the sponge is directed along the drainage channels 44 and through the drainage ports 46. In this manner, the cleaning head 12 can be rapidly and effectively wrung without moisture extracted from the cleaning head 12 being reabsorbed thereby as it might if the sponge cleaning head 12 was simply to be directly pressed against the surface to extract moisture therefrom. This is particularly important where the shower cleaner 10 is wrung by pressing against the shower floor, as with a vertical surface the force of gravity can alleviate some of the reabsorption problem.

To allow the sponge shower cleaner 10 to be easily stored in the shower area, and manipulated in the shower area for the cleaning and wringing functions previously described, the sponge shower cleaner 10 is provided with a compact design relative to floor cleaners, such as mops. In particular, the sponge shower cleaner 10 has a relatively short handle 48 which can be integral with the cleaning head holder 18, as seen in FIGS. 1–4. The handle 48 is connected to the bottom surface of the bottom portion 22 of the cleaning head holder 18 so that it is perpendicular thereto and spaced midway between the front and rear flanges 24 and 26, thereof. Likewise, the leading cleaning surface 34 faces in a direction that is perpendicular to the handle 48. As the handle 48 is relatively short, approximately two feet or less, and the leading cleaning surface 34 is oriented in a direction perpendicular to the handle 48, the sponge shower cleaner 10 can be readily used on a vertical shower wall with up and down strokes of the arm to easily clean the vertical surface, including the corners where two surfaces meet.

Figure 7:
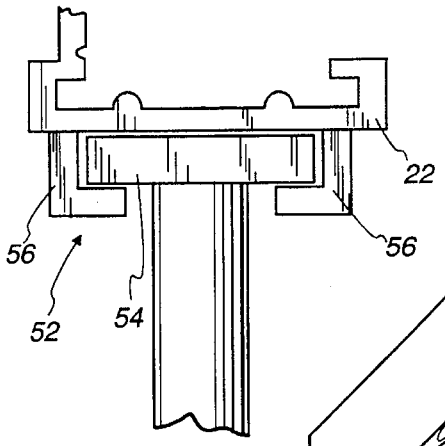
FIG. 7 is an enlarged side elevational view of another embodiment of the invention showing a separate handle and base configuration.
Figure 8:
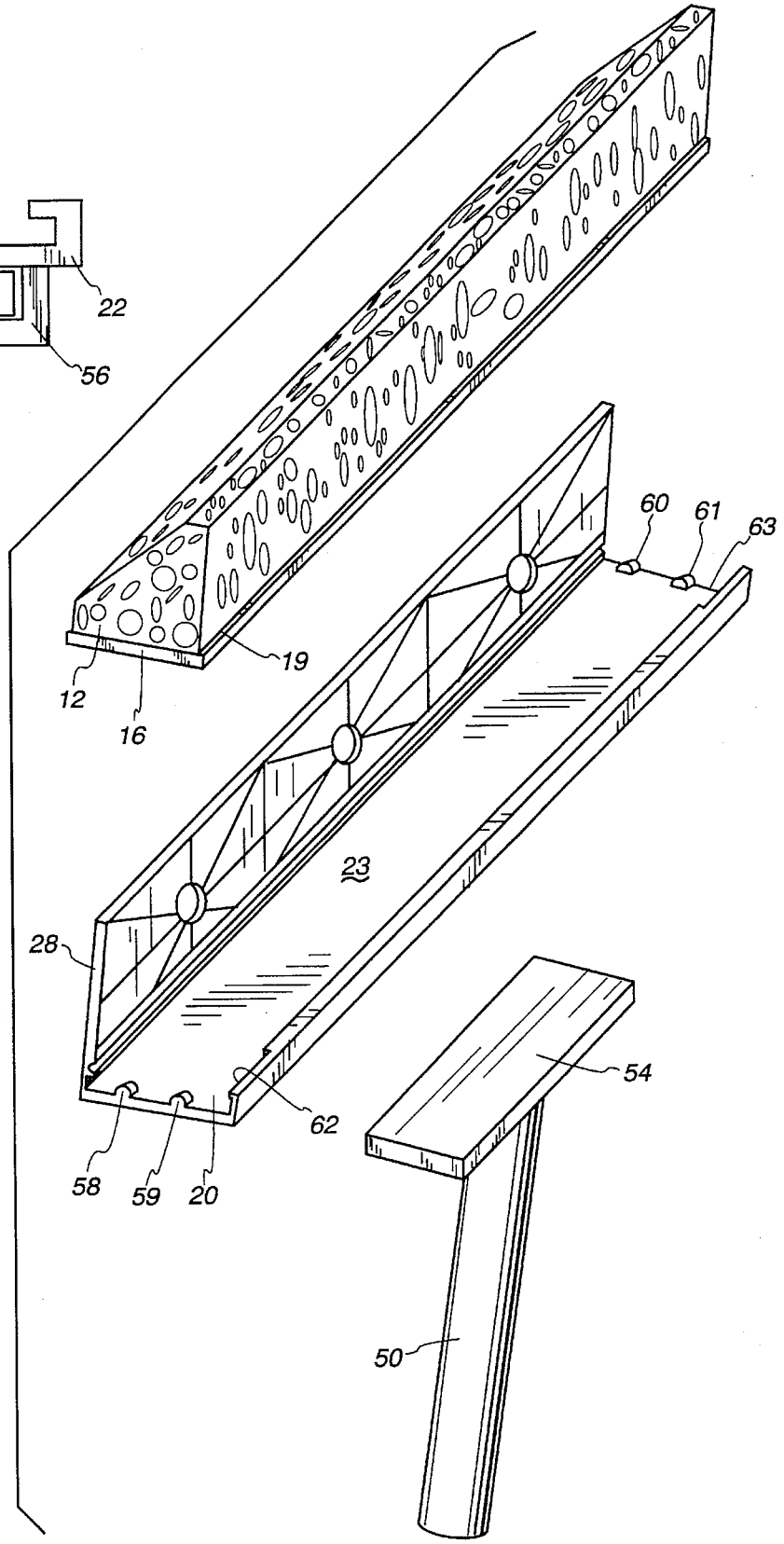
FIG. 8 is an exploded perspective view of the embodiment of the shower cleaner in FIG. 7 showing a separable cleaning head, base with a wringing member, and handle.

FIGS. 7 and 8 illustrate an alternative embodiment wherein a separate handle 50 is utilized with mounting structure 52 on the handle 50 and cleaning head holder 18 to attach the handle 50 to the holder 18. The mounting structure 52 can consist of a mounting plate 54 connected to the handle 50 and perpendicular thereto. The bottom portion of the track can be provided with a pair of elongate opposing L-shaped brackets 56 depending from the bottom portion 22 so as to tightly but releasably receive the mounting plate 54 therein, as best seen in FIG. 7.

Referring to FIG. 8, it can be seen that the cleaning head 12 is similarly removable from the guideway track 20 in both of the described embodiments. As described earlier, the cleaning head 12 is slidably received in the guideway track 20. The front and rear flanges 24 and 26 define inverted opposing L-shaped retaining flanges which along with a top surface 23 of the bottom portion 22 guide the cleaning head plate 16 as it is slid along the track 20. The flanges 24 and 26 also prevent the cleaning head 12 from being removed from the holder 18 by application of a pulling force on the sponge head 12 away from the bottom portion 22 of the track 20. Such a pulling force causes the lip 19 of the plate 16 to engage overhanging legs of the flanges 24 and 26 thereby resisting the pulling force and maintaining the cleaning head 12 in the track 20.

To prevent the cleaning head plate 16 from sliding off of the track 20, a pair of raised bosses 58 and 59 and 60 and 61 are provided on the top surface 23 at either end of the track 20 between the front and rear flanges 24 and 26. To allow the cleaning head plate 16 to be slid into the track 20 the front flange 24 includes cut-out sections 62 and 63 at either end thereof proximate the bosses 59 and 61, respectively. Thus, the cleaning head 12 and plate 16 can be inserted into the track 20 by bending the plate 16, which is preferably molded from a resilient plastic material similar to that used to form the holder 18 and wringing member 28, over either one of the pair of bosses 58 and 59 or 60 and 61 and sliding the cleaning head 12 into the track between the flanges 24 and 26 by means of the cut-out section 62. The cut-out sections 62 and 63 allow the plate 16 to be more easily biased over either one of the bosses 59 or 61 and then the corresponding other boss of the pair 60 or 58 so as to be slid into the track 20. Likewise, when the sponge cleaning head 12 needs to be replaced, the above operation is reversed with the plate 16 being flexed by inserting a finger under the lip 19 at one of the cut-out sections 62 or 63 to bend the plate 16 over the corresponding one of the pairs of bosses 58 and 59 or 60 and 61, to be slid out of the corresponding end of the track 20. Thus, the sponge cleaning head 12 is securely but removably retained in the guide track 20.

The foregoing disclosure and specific embodiments described are intended to be illustrative of the broad concepts comprehended by the invention.

What is claimed is:

1. A sponge shower cleaner for wiping a surface exposed to moisture such as a vertical shower wall, the sponge shower cleaner comprising:

an elongate cleaning head formed from an absorbent sponge material having a leading cleaning surface and an inclined surface extending away from the leading cleaning surface at an angle thereto;

a cleaning head mounting plate for supporting the elongate cleaning head thereon;

a cleaning head holder having a guideway track slidably receiving the cleaning head mounting plate;

a wringing member connected to the holder defining a space between the cleaning head inclined surface and the wringing member; and an elongate handle less than two feet in length connected to the holder to allow a user to orient the leading cleaning surface against and along the surface to be cleaned to pick up moisture and particulate matter therefrom, the handle being useable with one hand to press the wringing member and the inclined surface against a surface to compress the absorbent sponge material of the cleaning head to extract the moisture and particulate matter picked up by the cleaning head therefrom with the other free hand capable of being used for support while the sponge material is compressed, wherein the wringing member extends parallel to the leading cleaning surface and the space defined by the wringing member and inclined surface has an elongate wedge shape.

2. A sponge shower cleaner for wiping a surface exposed to moisture such as a vertical shower wall, the sponge shower cleaner comprising:

a cleaning head formed from an absorbent sponge material having a forward leading cleaning surface facing in a first direction;

a mounting plate for supporting the cleaning head thereon;

a cleaning head holder having a guideway track for removably remaining the cleaning head mounting plate thereon;

a wringing member connected to the holder and having a free end portion spaced rearwardly from the cleaning head forward leading cleaning surface; and an elongate handle less than two feet in length connected to the holder and extending perpendicular to the first direction to allow a user to grip the handle at a first position along its length and to orient the leading cleaning surface against and along the surface to be cleaned to pick up moisture and particulate matter therefrom, the handle being grippable with one hand at the first position thereon to press the wringing member against a surface to move the free end portion into engagement with the cleaning head to compress the absorbent material of the cleaning head to extract the moisture and particulate matter picked up by the cleaning head therefrom with the other free hand capable of being used for support during cleaning and wringing operations, wherein the cleaning head holder has a flat bottom surface connected to the handle with the handle extending perpendicular to the bottom surface.

3. A sponge shower cleaner for wiping a surface exposed to moisture such as a vertical shower wall, the sponge shower cleaner comprising:

a cleaning head formed form an absorbent sponge material having a forward leading cleaning surface facing in a first direction;

a mounting plate for supporting the cleaning head thereon;

a cleaning head holder having a guideway track for removably retaining the cleaning head mounting plate thereon;

a wringing member connected to the holder and having a free end portion spaced rearwardly from the cleaning head forward leading cleaning surface; and an elongate handle less than two feet in length connected to the holder and extending perpendicular to the first direction to allow a user to grip the handle at a first position along its length and to orient the leading cleaning surface against and along the surface to be cleaned to pick up moisture and particulate matter therefrom, the handle being grippable with one hand at the first position thereon to press the wringing member against a surface to move the free end portion into engagement with the cleaning head to compress the absorbent material of the cleaning head to extract the moisture and particulate matter picked up by the cleaning head therefrom with the other free hand capable of being used for support during cleaning and wringing operations, wherein the wringing member extends substantially parallel to the leading cleaning surface and the cleaning head has an inclined surface extending away from the leading cleaning surface at an angle thereto and towards the wringing member to define a space between the inclined surface and wringing member with the handle being usable with one hand to press the wringing member and the inclined surface against a surface to compress the absorbent material.

4. The sponge shower cleaner of claim 3 wherein the space defined by the wringing member and inclined surface has an elongate wedge shape.

5. A sponge shower cleaner for wiping a surface exposed to moisture such as a vertical shower wall, the sponge shower cleaner comprising:

a cleaning head formed from an absorbent sponge material having a leading cleaning surface;

a backing plate for supporting the cleaning head;

a cleaning head holder having a guideway track for receipt and mounting of the cleaning head backing plate thereon;

a wringing member pivotally connected to the holder and spaced from the cleaning head; and a handle connected to the holder to allow a user with one hand to move the cleaning head and wringing member from one of a cleaning position and a wringing position into the other of the cleaning position and the wringing position wherein in the cleaning position the wringing member is not pivoted and the leading cleaning surface can be oriented against and along the surface to be cleaned to pick up moisture therefrom and in the wringing position the wringing member is pivoted by pressing the wringing member against a surface to compress the absorbent material of the cleaning head to extract the moisture picked up by the cleaning head therefrom, wherein the leading cleaning surface and the wringing member each have an edge spaced in the same direction from the cleaning head holder with the distance between the cleaning head holder and the wringing member edge being greater than the distance between the cleaning head holder and the leading cleaning surface edge.

6. The sponge shower cleaner of claim 5 wherein the cleaning head has an inclined surface extending away from the leading cleaning surface at an angle thereto and towards the wringing member with the wringing member and the inclined surface being pressed against a surface to compress the absorbent material in the wringing position.

7. A cleaning apparatus having a cleaning head of absorbent, resilient material for cleaning surfaces in a shower by absorbing moisture accumulated on the shower surfaces and a wringing member for wringing the absorbed moisture from the cleaning head, the cleaning apparatus comprising:

an elongate leading cleaning surface on the cleaning head for engaging surfaces to be cleaned;

a cleaning head mount supporting the cleaning head with the leading cleaning surface facing forwardly in a first direction;

a wringing member attached at its bottom to the mount spaced rearwardly of the leading cleaning surface and extending substantially parallel to the leading cleaning surface;

an inclined surface on the cleaning head extending from adjacent the top of the leading cleaning surface downwardly at an angle towards the bottom of the wringing member to define an elongate space between the wringing member and inclined surface;

a free end portion on the wringing member spaced from the inclined surface which is movable into engagement with the cleaning head to allow the wringing member to compress the cleaning head; and a handle depending from the cleaning head mount which allows the user to grip the handle at a first position thereon to orient the leading cleaning surface against and along surfaces for cleaning of the surfaces and from the first gripping position on the handle to move the wringing member free end portion into compressing engagement with the cleaning head for wringing of the cleaning head, wherein the handle extends in a second direction perpendicular to the first direction.

* * * * *

UNITED STATES PATENT AND TRADEMARK OFFICE

CERTIFICATE OF CORRECTION

PATENT NO. : 5,575,032

DATED : November 19, 1996

INVENTOR(S) : Cernuska

It is certified that error appears in the above-indentified patent and that said Letters Patent is hereby corrected as shown below:

IN THE CLAIMS:

Claim 2- Column 6, line 63, change "remaining" to --retaining--.

Signed and Sealed this

Fourth Day of March, 1997

*Attest:*

*Attesting Officer*

BRUCE LEHMAN

*Commissioner of Patents and Trademarks*